US006863569B2

(12) United States Patent
Zhu et al.

(10) Patent No.: US 6,863,569 B2
(45) Date of Patent: Mar. 8, 2005

(54) HIGH PROFILE ELECTRICAL CONNECTOR

(75) Inventors: ZiQiang Zhu, Kunsan (CN); Jinkui Hu, Kunsan (CN); Guohua Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 23 days.

(21) Appl. No.: 10/631,566

(22) Filed: Jul. 30, 2003

(65) Prior Publication Data

US 2004/0229482 A1 Nov. 18, 2004

(30) Foreign Application Priority Data

May 16, 2003 (TW) ..... 92209059 U

(51) Int. Cl.[7] ..... H01R 13/648
(52) U.S. Cl. ..... 439/607; 439/717; 439/701
(58) Field of Search ..... 439/607, 701, 439/717, 594

(56) References Cited

U.S. PATENT DOCUMENTS 4,626,054 A * 12/1986 Tengler et al. ..... 439/594
5,427,549 A * 6/1995 Smith et al. ..... 439/594
6,234,841 B1 * 5/2001 Chang et al. ..... 439/609
6,280,209 B1 8/2001 Bassler et al.
6,315,608 B1 11/2001 Lopata et al.
6,447,311 B1 * 9/2002 Hu et al. ..... 439/607
6,482,037 B1 * 11/2002 Zhu et al. ..... 439/607
6,503,108 B1 * 1/2003 Kikuchi et al. ..... 439/594
6,585,540 B2 * 7/2003 Gutierrez et al. ..... 439/620
2001/0049227 A1 * 12/2001 Zhu et al. ..... 439/607

* cited by examiner

*Primary Examiner*—Tho D. Ta
(74) *Attorney, Agent, or Firm*—Wei Te Chung

(57) ABSTRACT

An electrical connector (1) includes a dielectric housing (12), a terminal subassembly (90), an inner shield (60) and an outer shield (70). The dielectric housing (12) includes a supporting portion (120) and a mating portion (138) defining a receiving space (124) above the supporting portion. The terminal subassembly includes first and second terminal modules (40, 80). The first and the second terminal modules respectively include first and second dielectric bodies (14, 16) retained in the receiving space and a number of first and second terminals (20, 30) received in the first and the second dielectric bodies. The first and the second dielectric bodies extend beyond the mating portion (138). The inner shield encloses the first and the second dielectric bodies and defines a first engaging space (2). The outer shield encircles the inner shield. The outer shield and the inner shield define a second engaging space (3) therebetween.

15 Claims, 8 Drawing Sheets

HIGH PROFILE ELECTRICAL CONNECTOR

BACKGROUND OF THE INVENTION

1. Field of the Invention

The present invention relates to an electrical connector, and particularly to a high profile electrical connector mounted on a printed circuit board.

2. Description of Related Art

With the development of communication and computer technology, electrical connectors for high-speed data transmission are widely used in electronic systems. IEEE1394 (Institute of Electrical and Electronics Engineers; IEEE) connectors are commonly used to connect external and internal peripheral devices to a computer for performing high speed data transmission therebetween. These connectors typically employ a plug connector terminated to a transmission cable and a receptacle connector mounted on a circuit board of the computer.

U.S. Pat. No. 6,315,608 discloses a receptacle connector comprising an insulative housing having a base portion and a mating portion, a plurality of conductive terminals retained in the housing, an inner shield enclosing the mating portion of the housing for electromagnetic interference protection, and an outer metal shield enclosing both the housing and the inner shield for further electromagnetic interference protection. In some special applications, a large distance is required between the mating portion and a printed circuit board (PCB) on which the receptacle connector is mounted. A high profile receptacle connector is accordingly developed to satisfy this requirment. However, the high profile receptacle connector may cause a variety of problem. For instance, as the complexity of the high profile housing increases, the difficulty of manufacturing the high profile housing increases. Another problem is that the terminals received in the high profile housing have elongated mounting potions, which results in that the elongated mounting portions are difficult to be positioned and therefore are inaccurately connected to the PCB.

Hence, an improved high profile electrical connector is desired to overcome the disadvantage of the prior art.

SUMMARY OF THE INVENTION

An object of the present invention is to provide a high profile electrical connector with terminal modules retained in a dielectric housing thereof.

To achieve the above object, an electrical connector in accordance with the present invention comprises a dielectric housing, a terminal subassembly, an inner shield and an outer shield. The dielectric housing comprises a supporting portion and a mating portion defining a receiving space above the supporting portion. The terminal subassembly comprises first and second terminal modules. The first and the second terminal modules respectively comprise first and second dielectric bodies retained in the receiving space and a plurality of first and second terminals received in the first and the second dielectric bodies. The first and the second dielectric bodies extend beyond the mating portion. The inner shield encloses the first and second dielectric bodies and defines a first engaging space. The outer shield encloses the dielectric housing and the inner shield, the outer shield and the inner shield define a second engaging space therebetween.

Other objects, advantages and novel features of the invention will become more apparent from the following detailed description when taken in conjunction with the accompanying drawings.

DETAILED DESCRIPTION OF THE PREFERRED EMBODIMENT

Figure 1:
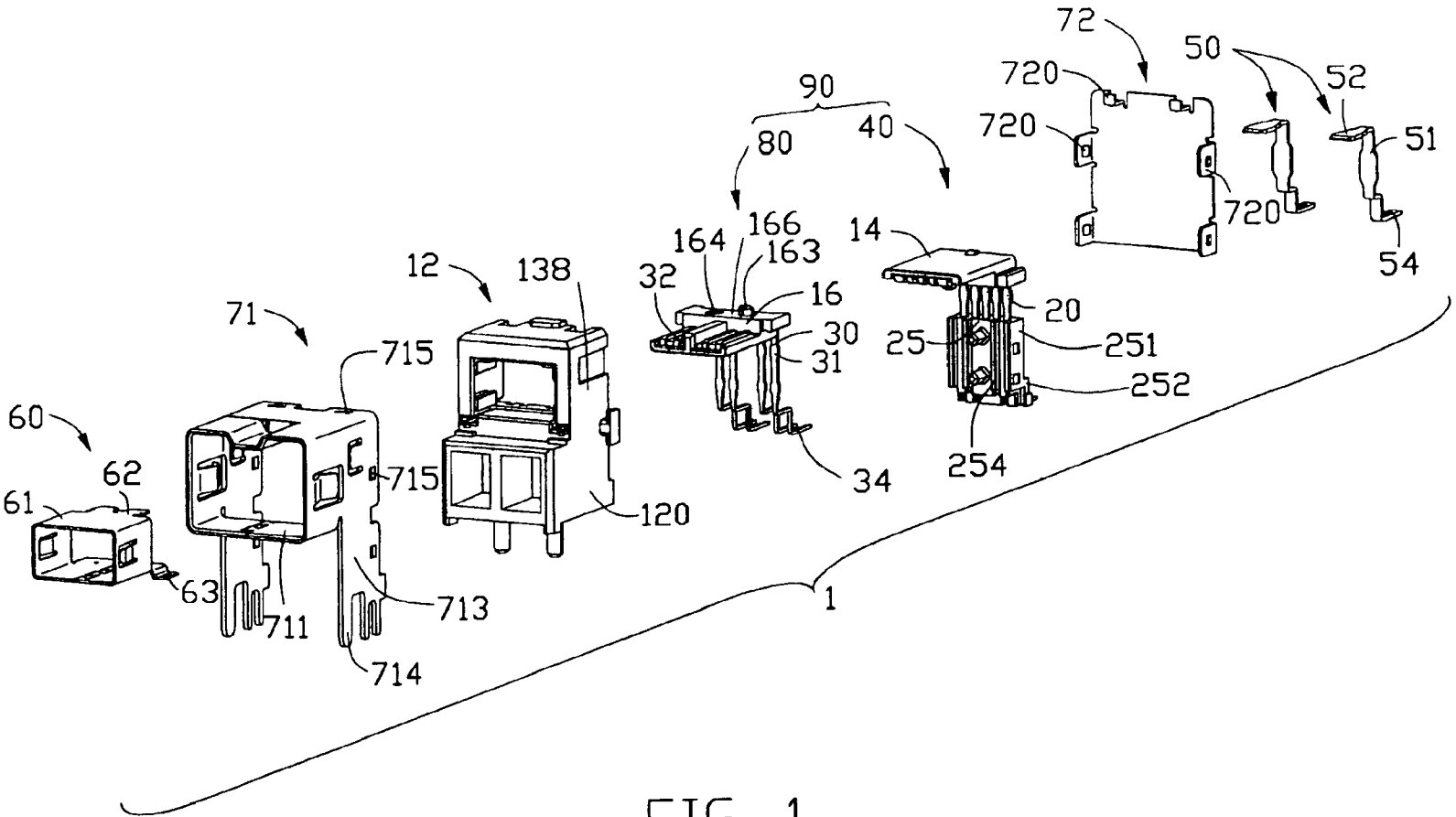
FIG. 1 is an exploded perspective view of an electrical connector in accordance with the present invention.
Figure 2:
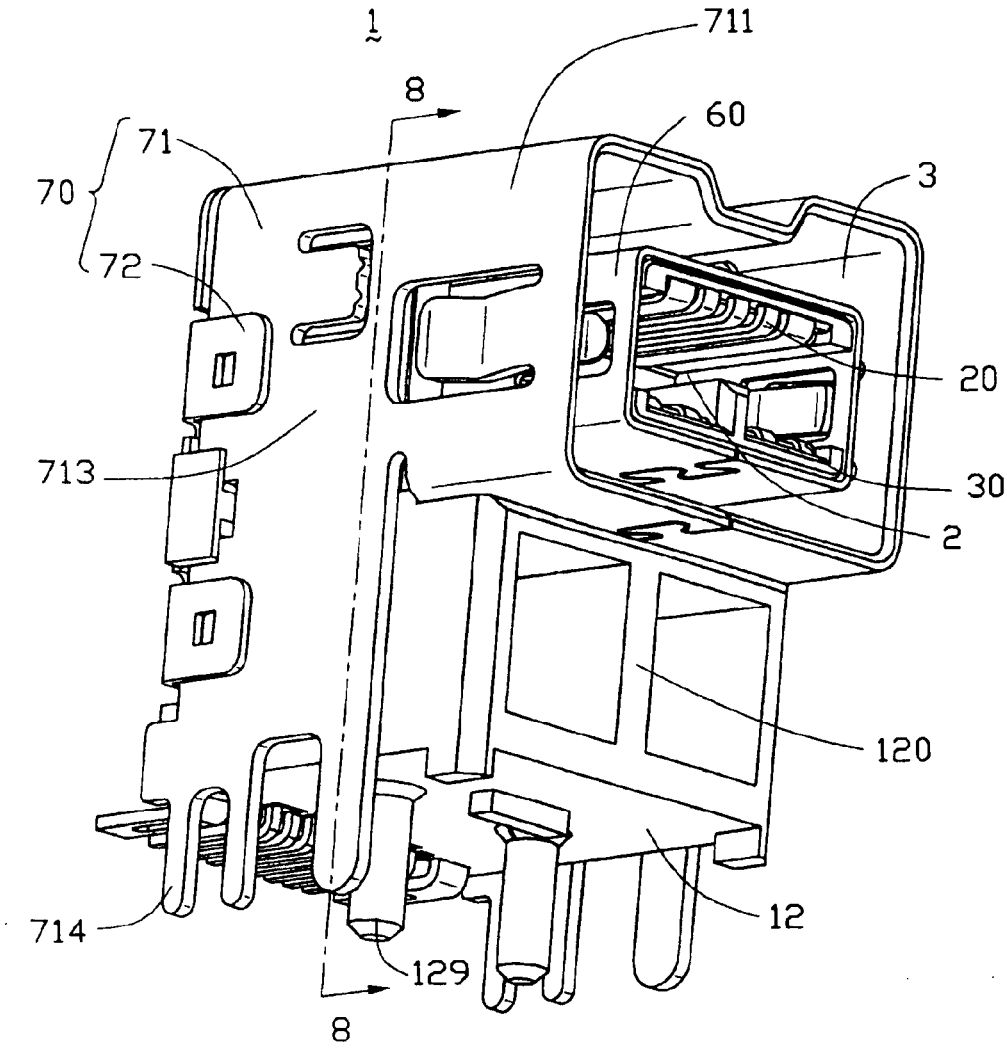
FIG. 2 is an assembled perspective view of the connector shown in FIG. 1.

Referring to FIGS. 1 and 2, an electrical connector 1 in accordance with the present invention comprises a dielectric housing 12, a terminal subassembly 90 received in the dielectric housing 12, an inner shield 60 enclosing the terminal subassembly 90, an outer shield 70 enclosing the dielectric housing 12 and a pair of grounding tabs 50 for electrically connecting with the inner shield 60.

Figure 3:
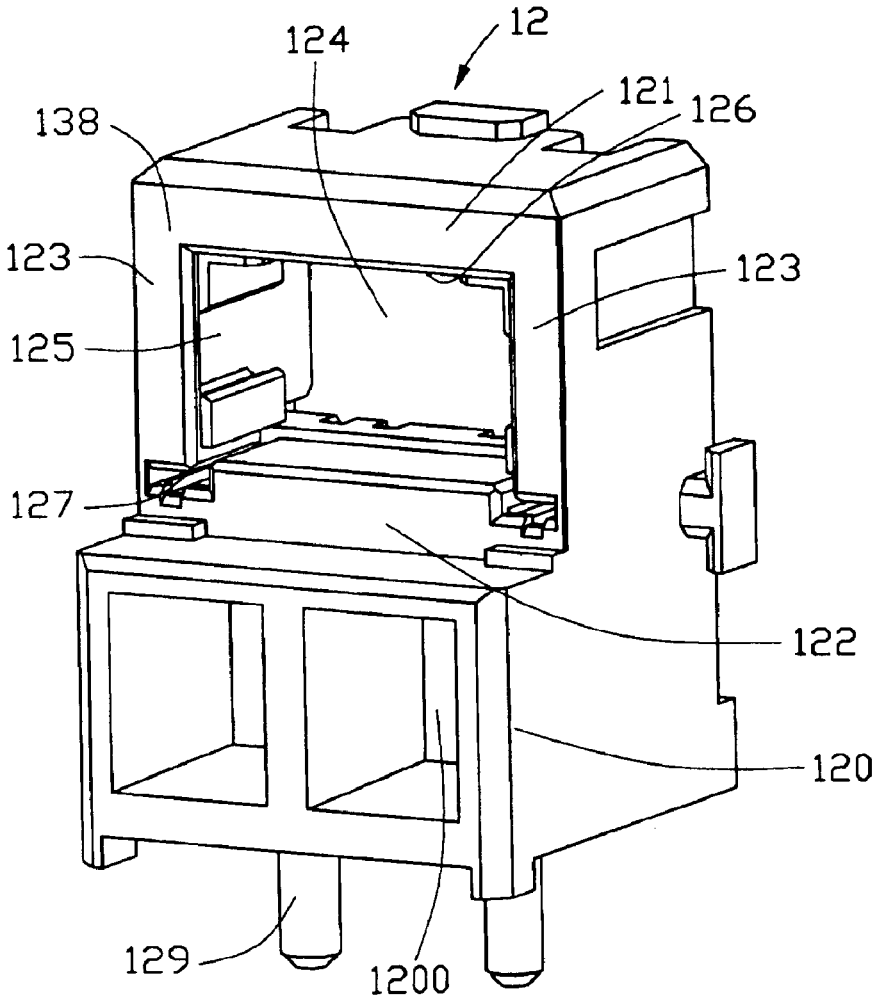
FIG. 3 is a front perspective view of a dielectric housing of the connector shown in FIG. 1.

Referring to FIG. 3, the dielectric housing 12 comprises a supporting portion 120 and a mating portion 138 located above the supporting portion 120. The supporting portion 120 defines a pair of chambers 1200 in a front face thereof for saving material. A plurality of posts 129 extends downwardly from a bottom face of the supporting portion 120 for being received in corresponding holes of a printed circuit board (PCB, not shown) on which the connector 1 is mounted. The mating portion 138 comprises opposite upper and lower walls 121, 122 and a pair of opposite side walls 123 interconnecting the upper and the lower walls 121, 122. The upper and the lower walls 121, 122, and the side walls 123 together define a receiving space 124 therebetween. Each side wall 123 defines a swallow-tailed groove 125 communicating with the receiving space 124 in an inner face thereof. The upper wall 121 defines a recess 126 communicating with the receiving space 124 in an inner face thereof. The mating portion 138 defines a pair of channels 127 communicating with the receiving space 124 at two junctures of the side walls 123 and the lower wall 122.

Figure 4:
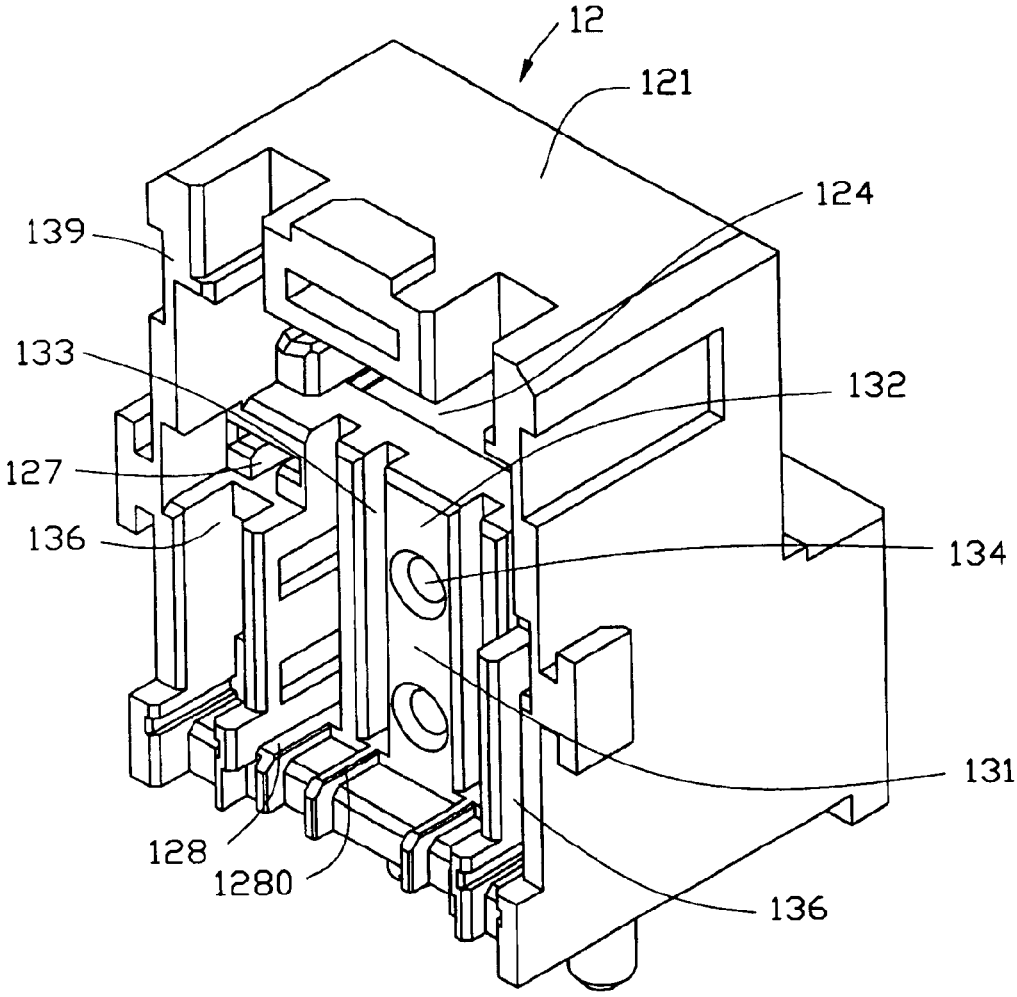
FIG. 4 is a rear perspective view of the dielectric housing shown in FIG. 3.
Figure 5:
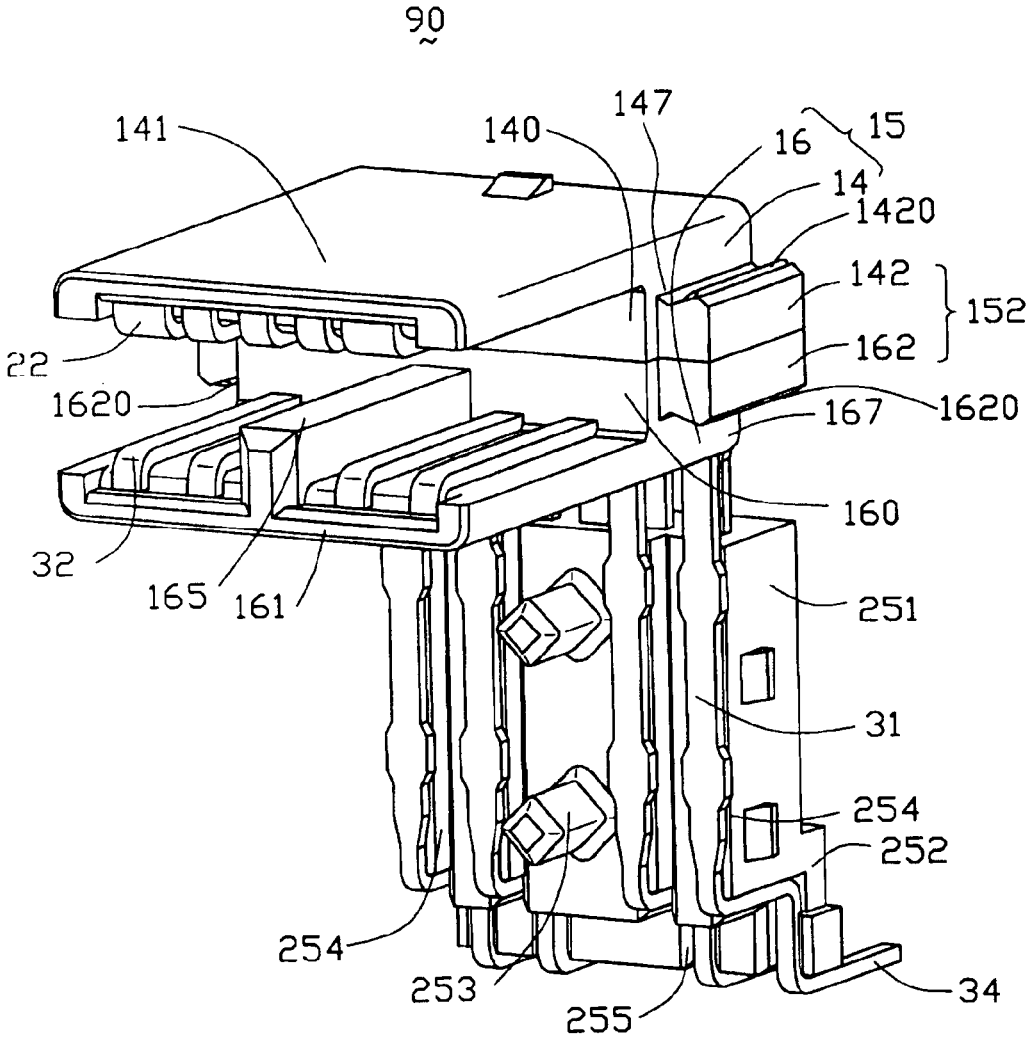
FIG. 5 is a perspective view of a terminal subassembly of the connector shown in FIG. 1.
Figure 6:
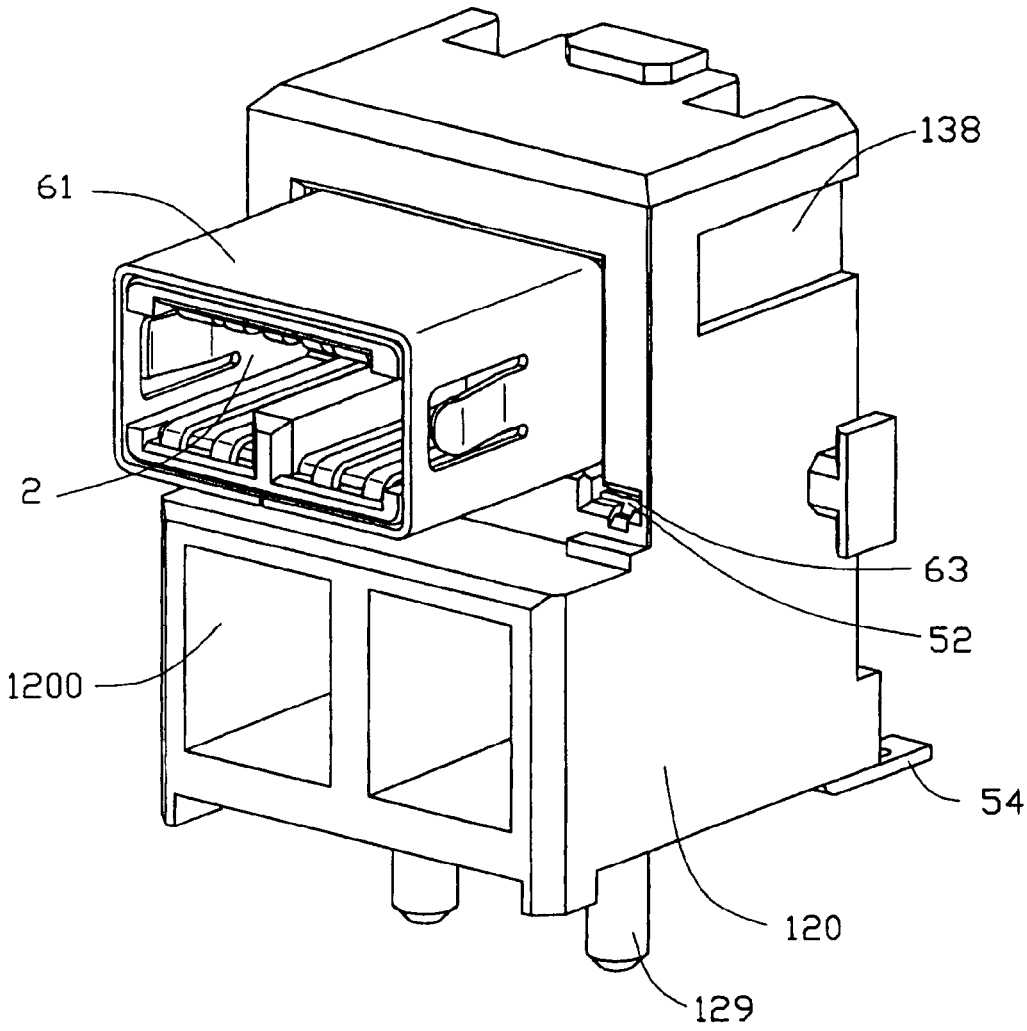
FIG. 6 is a front perspective view of the connector shown in FIG. 1, prior to assembly of an outer shield.
Figure 7:
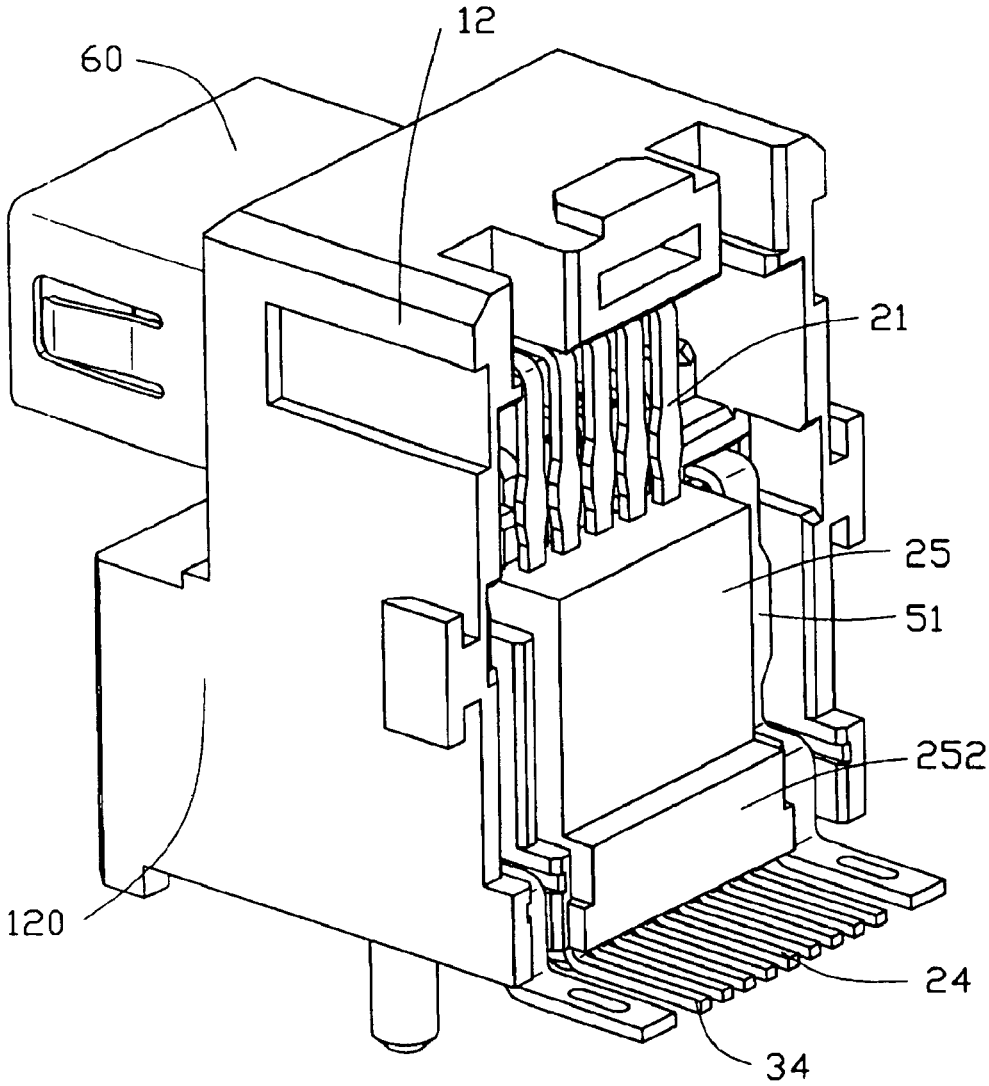
FIG. 7 is a view similar to FIG. 6 but taken from a different perspective.
Figure 8:
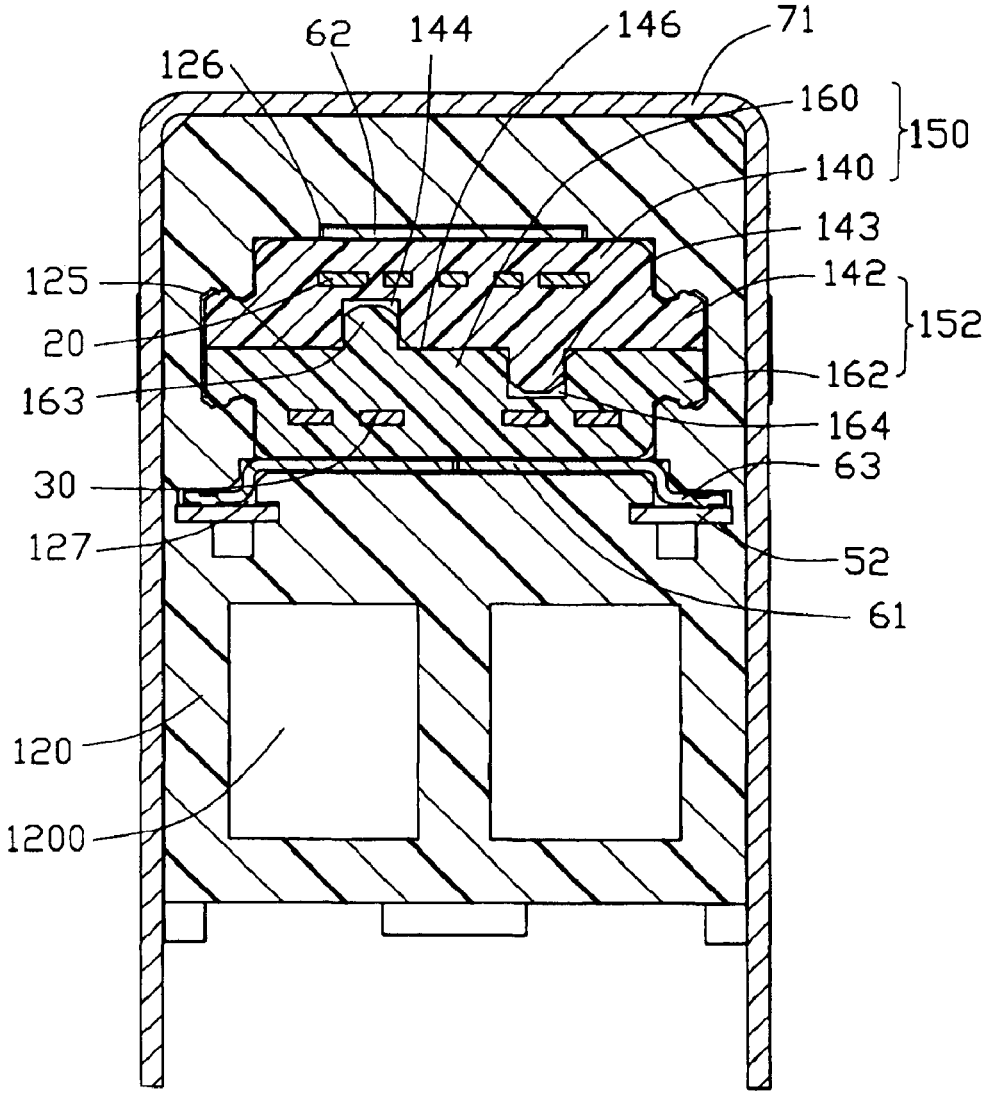
FIG. 8 is a cross-sectional view of the connector taken along line 8—8 in FIG. 2.

Referring to FIG. 4, the dielectric housing 12 defines a cavity 131 in a rear face 139 thereof and communicating with the receiving space 124. An inside wall 132 of the cavity 131 defines a plurality of passageways 133 communicating with the receiving space 124 and a pair of holes 134 between the passageways 133. The dielectric housing 12 defines a pair of slots 136 communicating with the corresponding channels 127 at opposite ends of the rear face 139. The dielectric housing 12 comprises a first ladder portion 128 extending rearwardly from a lower end of the rear face 139 thereof. The first ladder portion 128 is formed with a plurality of bulges 1280 aligned with the corresponding passageways 133.

Referring back to FIG. 1, the terminal subassembly 90 comprises a first terminal module 40 and a second terminal module 80. The first terminal module 40 comprises a first dielectric body 14, a plurality of first terminals 20 partially retained in the first dielectric body 14 and a spacer 25 in which the first terminals 20 partially retained in. The second terminal module 80 comprises a second dielectric body 16 and a plurality of second terminals 30 retained in the second dielectric body 16, the first and the second dielectric body 14, 16 form a dielectric body 15.

Referring to FIGS. 5, 6, 7 and 8, the first and the second dielectric bodies 14, 16 are stacked with each other. Each of the first and the second dielectric bodies 14, 16 comprises a base 140, 160 having an engaging face 146, 166 (FIG. 1) and a pair of opposite side faces 147, 167, and a tongue 141, 161 extending forwardly from a front face of the base 140, 160. Each base 140, 160 comprises a hole 144, 164 defined in the engaging face 146, 166 and a post 143, 163 formed on the engaging face 146, 166. The hole 144 and the post 143 of the base 140 of the first dielectric body 14 respectively engage with the corresponding post 163 and hole 164 of the base 160 of the second dielectric body 16 for securing the first and the second terminal modules 40, 80 together. The base 140 of the first dielectric body 14 and the base 160 of the second dielectric body 16 form a retaining member 150 received in the receiving space 124 of the dielectric housing 12. Each base 140, 160 is formed with a pair of opposite projections 142, 162 on the opposite side faces 147, 167 thereof. Each projection 142, 162 is formed with a rib 1420, 1620 thereon. The projections 142 of the first dielectric body 14 and the corresponding projections 162 of the second dielectric body 16 form a pair of swallow-tailed protrusions 152 retained in the corresponding swallow-tailed grooves 125 of the dielectric housing 12 with the ribs 1420, 1620 interferentially engaging with inner faces of the grooves 125. The tongue 141, 161 is parallel to laterally offset from each other and projected beyond a front face of the mating portion 138. The tongue 161 of the second dielectric body 16 is formed with a key 165 extending upwardly toward the tongue 141 of the first dielectric body 14 for ensuring a blind mating of a complementary connector.

Each of the first and the second terminals 20, 30 is insert-molded in the base 140, 160 respectively and comprises a vertical intermediate portion 21, 31, a contact portion 22, 32 extending forwardly from the intermediate portion 21, 31 on an inner face of the tongue 141, 161 of the first and the second dielectric bodies 40, 80 and a solder tail 24, 34 extending from the intermediate portion 21, 31 for connecting with a corresponding pad of the PCB.

The spacer 25 comprises a main portion 251 received in the cavity 131 of the dielectric housing 12 and a second ladder portion 252 engaging with the first ladder portion 128. The intermediate portions 21 of the first terminals 20 are partially insert-molded in the main portion 251 and the second ladder portion 252. The main portion 251 is formed with a pair of posts 253 and a plurality of ribs 254 on a front face thereof. The posts 253 of the main portion 251 are fit in the corresponding holes 134 of the inner wall 132 of the cavity 131. The intermediate portions 31 of the second terminals 30 are snugly sandwiched between the corresponding ribs 254 of the main portion 251 and the corresponding passageways 133 of the inner wall 132 of the dielectric housing 12. The second ladder portion 252 defines a plurality of cutouts 255 aligned with the ribs 254 of the main portion 251. The cutouts 255 are fit in the corresponding bulges 1280 with lower ends of the intermediate portions 31 of the corresponding second terminals 31 sandwiched therebetween.

Referring back to FIGS. 1 and 2, the inner shield 60 and the outer shield 70 are stamped from metallic material. The inner shield 60 comprises a shroud 61 enclosing the tongues 141, 161 of the first and the second dielectric bodies 14, 16 and defining a first engaging space 2 therein, a retaining tab 62 extending rearwardly from an upper wall of the shroud 61 to be retained in the recess 126 of the dielectric housing 12, and a pair of grounding fingers 63 extending curvedly and laterally from opposite ends of a lower wall of the shroud 61 to be received in the corresponding channels 127 of the dielectric housing 12. Each grounding tab 50 comprises an intermediate portion 51 received in the corresponding slot 136 of the dielectric housing 12, a contact portion 52 extending forwardly from the intermediate portion 51 into the corresponding channel 127 and contacting with the grounding finger 63 and a solder tail 54 extending horizontally from the intermediate portion 51 for electrically connecting with a grounding pad of the PCB.

The outer shield 70 comprises a front shield 71 and a rear shield 72 both attached to the dielectric housing 12. The front shield 71 comprises a shroud 711 enclosing the shroud 61 of the inner shield 60 and the mating portion 138 of the dielectric housing 12, and a pair of opposite side walls 713 extending downwardly from the shroud 711 to cover side faces of the dielectric housing 12. The shroud 61 of the inner shield 60 and the shroud 711 of the front shield 71 together define a second engaging space 3 therebetween. Each side wall 713 is formed with a grounding tail 714 for connecting with the grounding path of the PCB. The side walls 713 and the shroud 711 define a plurality of openings 715 therein. The rear shield 72 covers the rear face 139 of the dielectric housing 12 and is formed with a plurality of tabs 720 engaging with the openings 715 of the front shield 71.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a supporting portion and a mating portion above the supporting portion, the mating portion defining a receiving space therein;

a terminal subassembly comprising first and second terminal modules, the first and the second terminal modules respectively comprising first and second dielectric bodies retained in the receiving space and a plurality of first and second terminals received in the first and the second dielectric bodies, the first and the second dielectric bodies extending beyond the mating portion;

an inner shield enclosing the first and the second dielectric body and defining a first engaging space therein; and an outer shield enclosing the dielectric housing and the inner shield, the outer shield and the inner shield defining a second engaging space therebetween;

wherein each of the first and the second dielectric bodies comprises a base received in the receiving space and a tongue extending from the base beyond the mating portion;

wherein the mating portion defines a swallow-tailed groove communicating with the receiving space, and wherein each base of the first and the second terminal modules is formed with a pair of projections, the projections of the first and the second dielectric bodies forming a pair of swallow-tailed protrusion engaging with the grooves of the mating portion.

2. The electrical connector as claimed in claim 1, wherein each projection is formed with a rib inferentially engaging with the groove of the mating portion.

3. The electrical connector as claimed in claim 1, wherein each base comprises a post formed thereon and a hole defined therein, and wherein the post and the hole of the first dielectric body are fit in corresponding hole and post of the second dielectric body.

4. The electrical connector as claimed in claim 1, further comprising a grounding tab comprising a contact portion, and wherein the dielectric housing defines a channel receiving the contact portion of the grounding tab therein, and the inner shield comprises a grounding finger extending into the channel and electrically connecting with the contact portion.

5. The electrical connector as claimed in claim 1, wherein the outer shield comprises a front shield and a rear shield locked with each other to enclose the dielectric housing.

6. The electrical connector as claimed in claim 1, wherein the first and the second terminals are insert-molded in the base of the first and the second dielectric bodies, and wherein each of the first and the second terminals comprises an intermediate portion and a contact portion extending from the intermediate portion to be exposed in the first engaging space.

7. The electrical connector as claimed in claim 6, wherein the dielectric housing defines a cavity in a rear face thereof, and wherein the first terminal module comprises a spacer received in the cavity with the intermediate portions of the first terminals being insert-molded in the spacer.

8. The electrical connector as claimed in claim 7, wherein the dielectric housing defines a plurality of passageways communicating with the cavity, and wherein the spacer is formed with a plurality of ribs engaging with corresponding passageways with the intermediate portions of the second terminals being sandwiched between the corresponding ribs and the passageways.

9. The electrical connector as claimed in claim 7, wherein the dielectric housing comprises a first ladder portion, and wherein the spacer comprises a second ladder portion engaging with the first ladder portion.

10. The electrical connector as claimed in claim 9, wherein the first ladder portion of the dielectric housing is formed with a plurality of bulges, and wherein the second ladder portion of the spacer defines a plurality of cutouts receiving the corresponding bulges of the dielectric housing.

11. An electrical connector comprising:

a dielectric housing comprising a supporting portion and a mating portion above the supporting potion, the mating portion defining a receiving space;

a terminal subassembly comprising a retaining member received in the receiving space and a plurality of terminals retained in the retained member; and the mating portion and the retaining member comprising a swallow-tailed groove and a swallow-tailed protrusion engaging with the groove;

wherein the groove is defined in the mating portion and communicates with the receiving space, and wherein the protrusion is formed on the retaining member;

wherein the terminal subassembly comprises first and second dielectric bodies each comprising a base and a tongue extending from the base beyond the mating portion, and wherein the bases of the first and the second dielectric housing together form the retained member.

12. The electrical connector as claimed in claim 11, wherein the base comprises a post formed thereon and a hole defining therein, and wherein the post and the hole of the first dielectric body are fit in the post and the hole of the second dielectric body.

13. The electrical connector as claimed in claim 11, further comprising an inner shield enclosing the tongues of the first and the second dielectric bodies and defining a first engaging space therein.

14. The electrical connector as claimed in claim 13, further comprising an outer shield enclosing the dielectric housing and the inner shield, the outer shield and the inner shield defining a second engaging space therebetween.

15. An electrical connector comprising:

a terminal subassembly including stacked first and second terminal modules, said first terminal module and said second terminal module respectively defining first and second dielectric bodies with a first set of terminals and a second set of terminals thereof, a first base of said first dielectric body and a second base of said second dielectric body abutting against each other while a first tongue extending from the first base being oppositely spaced from a second tongue extending from the second base so as to define a space therebetween for receiving a complementary connector, said first set of terminals in said first tongue and said second set of terminals in said second tongue commonly communicating with said space and facing toward each other;

an metallic shell enclosing at least said first and second tongues of said terminal subassembly; and complementary interengaging attachment means formed on both said first base and said second base for securing said first dielectric body and said second dielectric body together;

wherein said first dielectric body and said second dielectric body include respective projections commonly received in a mating portion of a dielectric housing for securing said terminal subassembly to the housing;

where said first terminal module further includes a spacer through which vertical portions of the first set of terminals extend, said space engaging the second set of terminals and retainably secured to a dielectric housing, to which said terminal subassembly is assembled.

* * * * *